United States Patent [19]

Horie

[11] 4,149,618

[45] Apr. 17, 1979

[54] ENGINE BRAKE CONTROL SYSTEM

[75] Inventor: Mitsuyuki Horie, Susono, Japan

[73] Assignee: Toyota Jidosha Kogyo Kabushiki Kaisha, Aichi, Japan

[21] Appl. No.: 830,147

[22] Filed: Sep. 2, 1977

[30] Foreign Application Priority Data

Apr. 21, 1977 [JP] Japan ..... 52-046566

[51] Int. Cl.[2] ..... F02D 9/06

[52] U.S. Cl. ..... 188/273; 123/97 B

[58] Field of Search ..... 123/97 B, 107; 188/273; 192/4 A

[56] References Cited

U.S. PATENT DOCUMENTS 2,924,205 2/1960 Williams ..... 123/97 B 4,061,215 12/1977 Ishikawa ..... 188/273 X

FOREIGN PATENT DOCUMENTS 732829 6/1955 United Kingdom ..... 188/273

*Primary Examiner*—Duane A. Reger

*Attorney, Agent, or Firm*—Oblon, Fisher, Spivak, McClelland & Maier

[57] ABSTRACT

An engine brake control system comprises a cut-off valve disposed within an exhaust pipe of an internal combustion engine to block the exhausted gas flowing through the pipe and a vacuum motor having a spring loaded diaphragm piston operatively connected to the cut-off valve to close the valve in response to release of an accelerator pedal. In the vacuum motor, first and second chambers facing to the diaphragm piston are communicated with a vacuum source to open the valve during depression of the accelerator pedal in such a manner that only the second chamber is communicated with the atmospheric pressure in response to release of the accelerator pedal to swiftly operate the piston.

6 Claims, 3 Drawing Figures

ENGINE BRAKE CONTROL SYSTEM

BACKGROUND OF THE INVENTION

Field of the invention

The present invention relates to braking systems for automobiles, and more particularly to an engine brake control system of the type in which a cut-off valve is provided within an exhaust pipe of an internal combustion engine to block the exhausted gas in response to the release of an accelerator pedal to thereby increase the engine braking effect.

In the engine brake control system of this kind, a vacuum motor is generally provided to open and close the cut-off valve in response to operation of the accelerator pedal. Accordingly, it is required that the vacuum motor is swiftly activated in response to operation of the accelerator pedal to ensure the operation of the control system.

SUMMARY OF THE INVENTION

The primary object of the present invention is, therefore, to provide an engine brake control system wherein first and second chambers facing a spring loaded diaphragm piston in the vacuum motor are communicated with a vacuum source during depression of the accelerator pedal to open the cut-off valve in such a manner that only the second chamber is communicated with the atmospheric pressure in response to release of the accelerator pedal to swiftly operate the piston so as to close the cut-off valve.

BRIEF DESCRIPTION OF THE DRAWINGS

The above and other objects, features and advantages of the present invention will become more readily apparent from the following description of the preferred embodiment with reference to the accompanying drawings forming a part of the specification wherein.

DESCRIPTION OF THE PREFERRED EMBODIMENT

Figure 1:
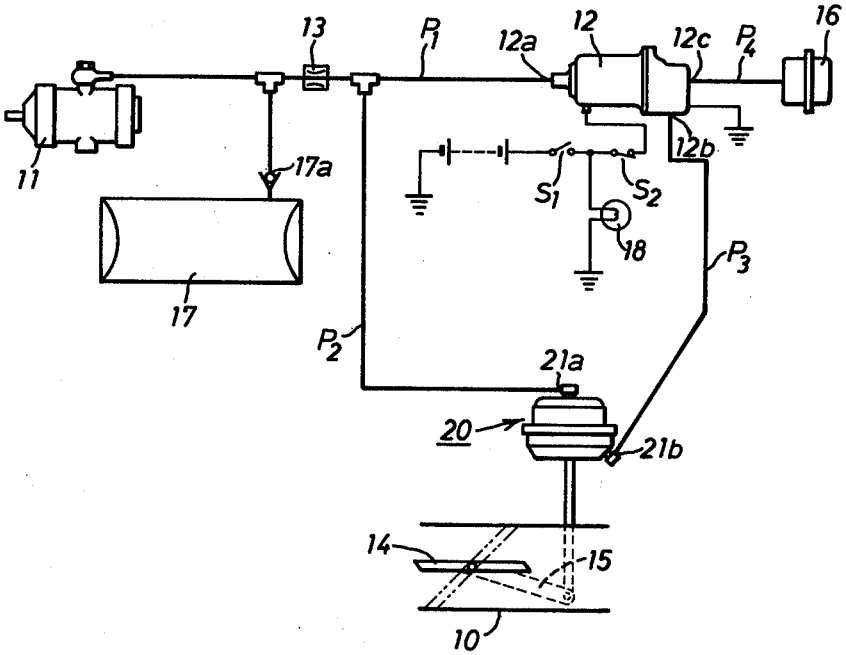
FIG. 1 is a diagrammatic view showing an engine brake control system in accordance with the present invention.

Referring now to the drawings, and in particular FIG. 1, there is illustrated a portion of an exhaust pipe 10 of an internal combustion engine, a vacuum pump 11 driven by the engine, and an electrically operated switch-over valve 12. A suction port of the vacuum pump 11 is connected by way of a pipe $P_1$ to a first port 12*a* of the switch-over valve 12 through an orifice 13. Pivoted within the exhaust pipe 10 is a cut-off valve 14 in the form of a butterfly valve which is actuated by a vacuum motor 20 by way of a link assembly 15.

Figure 2:
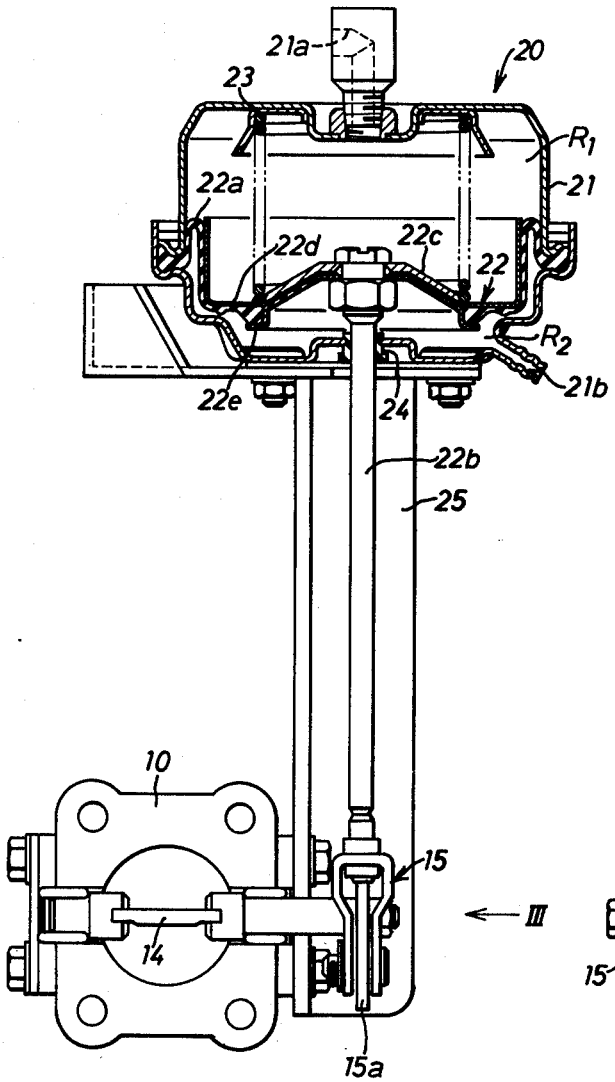
FIG. 2 is an enlarged vertical sectional view of a vacuum motor shown in FIG. 1.
Figure 3:
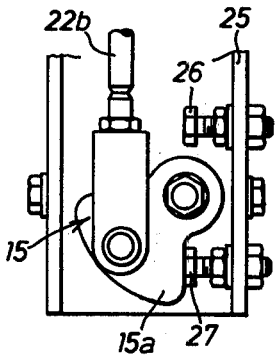
FIG. 3 is a side view of a link assembly shown in FIG. 2, looking in the direction of the arrow III.

As shown in FIGS. 2 and 3, the vacuum motor 20 comprises a housing 21 and a diaphragm piston assembly 22 reciprocable within the housing 21. The housing 21 is mounted on a bracket member 25 which is secured to one side of the exhaust pipe 10. The housing 21 is provided thereon with a first port 21*a* and a second port 21*b*, the former being connected by way of a pipe $P_2$ to the pipe $P_1$ between the orifice 13 and the switch-over valve 12 and the latter being connected by way of a pipe $P_3$ to a second port 12*b* of the switch-over valve 12 (see FIG. 1).

The diaphragm piston assembly 22 includes a diaphragm 22*a* hermetically secured at its outer periphery to the inner peripheral wall of the housing 21 and an operation rod 22*b* fixed at its upper end with the central portion of the diaphragm 22*a* by way of protector plates 22*c*, 22*d* and 22*e*. Thus, the interior of the housing 21 is subdivided by the diaphragm 22*a* into an upper chamber $R_1$ in communication with the first port 21*a* and a lower chamber $R_2$ in communication with the second port 21*b*. The diaphragm piston assembly 22 is biased downwardly toward the lower chamber $R_2$ by means of a compression coil spring 23 interposed between the inner wall of the housing 21 and the protector plate 22*c*. The operation rod 22*b* is extended outwardly through a seal member 24 from the housing 21 and connected at its lower end with the link assembly 15. The moving stroke of the rod 22*b* is restricted by engagement of an arm 15*a* of the link assembly 15 against a pair of stoppers 26 and 27 secured to a flange of the bracket member 25.

The switch-over valve 12 is to be energized in response to closing of a manual switch $S_1$ and a normally closed accelerator switch $S_2$. The manual switch $S_1$ is installed on a portion of a steering column assembly or an instrument panel of the vehicle. The accelerator switch $S_2$ is arranged to be opened by depression of an accelerator pedal and to be closed upon release of the accelerator pedal.

With the switch-over valve 12, the first port 12*a* is communicated with the second port 12*b* during deenergization of the valve 12 and the second port 12*b* is communicated with the third port 12*c* upon energization of the valve 12. The third port 12*c* is in open communication with the atmospheric air through a pipe $P_4$ and an air cleaner 16. Furthermore, a vacuum tank 17 for a conventional brake booster is connected through a check valve 17*a* to the pipe $P_1$ between the orifice 13 and the vacuum pump 11, and an indication lamp 18 is provided to be lighted by closing of the manual switch $S_1$.

In operation of the engine brake control system having the above-mentioned construction, when the manual switch $S_1$ is in open during travelling of the vehicle, the switch-over valve 12 is deenergized regardless of the operation of the accelerator switch $S_2$ to connect the first port 12*a* with the second port 12*b*. Under this mode, the upper and lower chambers $R_1$ and $R_2$ in the vacuum motor 20 are respectively communicated with the vacuum pump 11 to be applied negative pressure therein. As a result, the diaphragm piston assembly 22 is in the downward stroke end due to biasing force of the coil spring 23, as shown in FIGS. 2 and 3, thereby to fully open the cut-off valve 14, as shown in FIG. 1.

When the manual switch $S_1$ is closed under the above-mentioned condition, the lamp 18 is lighted and teh switch-over valve 12 may be electrically controlled in response to the operation of the accelerator switch $S_2$. Thereafter, when the accelerator pedal is released during the travelling of the vehicle to cause the engine braking operation, the accelerator switch $S_2$ is closed to energize the switch-over valve 12. Upon energization of the switch-over valve 12, the second port 2*b* is communicated with the third port 12*c* so that the atmospheric pressure is swiftly applied into the lower chamber $R_2$ of the vacuum motor 20 by way of the air cleaner 16 and the pipes $P_3$ and $P_4$. Then, the diaphragm piston assembly 22 is moved up against the spring 23 due to a difference in pressure between the upper and lower chambers $R_1$ and $R_2$ until the arm 15*a* of the link assembly 15 is engaged with the stopper 26. This closes the cut-off valve 14 to block the gas exhausted from the engine. Thus, the braking effect is instantly increased by back pressure applied to the engine in response to closing of the cut-off valve 14.

When the accelerator pedal is depressed again to accelerate the vehicle, the accelerator switch $S_2$ is opened and, in turn, the switch-over valve 12 is deenergized to connect the first port 12*a* to the second port 12*b*. Then, the lower chamber $R_2$ of the vacuum motor 20 is communicated with the upper chamber $R_1$ by way of the pipe $P_3$, the valve 12, the pipe $P_1$ and the pipe $P_2$ so that pressures in the two chambers $R_1$ and $R_2$ are balanced in negative valve. Thus, the diaphragm piston assembly 22 is moved down by the biasing force of the spring 23 until the arm 15*a* of the link assembly 15 is engaged with the stopper 27. This opens the cut-off valve 14 to open the exhaust pipe 10 so as to release the back pressure: In this mode, atmospheric air in the lower chamber $R_2$ is communicated or sucked through the orifice 13 into the vacuum pump 11. This means that the orifice 13 serves to reduce the instant load applied to the vacuum pump 11.

Although the present invention has been illustrated and described in connection with a specific embodiment, various adoptation and modifications will become apparent to those skilled in the art from the description in conjunction with the appended claims without departing from the scope and spirit of the present invention.

What is claimed as new and desired to be secured by Letters Patent of the United States is:

1. In combination with an engine brake control system which comprises a cut-off valve disposed within an exhaust pipe of an internal combustion engine to block the flow of exhaust gas and a vacuum motor for opening said cut-off valve in its deactivation and closing said cut-off valve in response to release of an accelerator pedal, said vacuum motor including a spring loaded diaphragm piston operatively connected to said cut-off valve to be activated by difference in pressure between first and second chambers facing to both faces of said piston;

the improvement of which comprises:

a first communication passage member connecting a vacuum source to the first chamber of said vacuum motor;

a second communication passage member bifurcated from said first communication passage member to provide fluidic interconnection between the first and second chambers of said vacuum motor; and a switch-over valve disposed within said second communication passage member for connecting the second chamber to the first chamber in response to depression of the accelerator pedal to deactivate said vacuum motor and for connecting the second chamber to the atmospheric pressure in response to release of the accelerator pedal to activate said vacuum motor.

2. The improvement in an engine brake control system as claimed in claim 1, wherein said vacuum source is a vacuum pump driven by the engine, and flow regulating means is disposed within said first communication passage member to throttle the air into said pump from the first and second chambers of said vacuum motor.

3. The improvement in an engine brake control system as claimed in claim 1, wherein said switch-over valve is an electrically operated valve to connect the second chamber of said vacuum motor to the atmospheric pressure in energization thereof and to connect the second chamber to the first chamber of said vacuum motor in deenergization thereof, and switch means to connect said electrically operated valve to an electric power source in response to release of the accelerator pedal and to disconnect said electrically operated valve from the electric power source in response to depression of the accelerator pedal.

4. The improvement in an engine brake control system as claimed in claim 3, further comprising a manual switch interposed between said switch means and said electric power source to be closed by the operator.

5. The improvement in an engine brake control system as claimed in claim 4, wherein an indication means is connected to said manual switch to be energized during closure of said manual switch.

6. The improvement in an engine brake control system as claimed in claim 1, wherein said vacuum source is a vacuum pump driven by the engine, and a vacuum tank is connected to said first communication passage member through a check valve to accumulate vacuum pressure therein.

* * * * *